US005328185A

United States Patent [19]

Finnigan et al.

[11] Patent Number: 5,328,185

[45] Date of Patent: Jul. 12, 1994

[54] GOLF PUTTER

[76] Inventors: Harry J. Finnigan, 1236 Mariana Ct.; Thomas A. Murphy, 875 S. Heathwood Dr., both of Marco Island, Fla. 33937

[21] Appl. No.: 11,167

[22] Filed: Jan. 29, 1993

[51] Int. Cl.[5] ..... A63B 69/36; A63B 53/16

[52] U.S. Cl. ..... 273/186.2; 273/77 R; 273/81.3; 273/81.2

[58] Field of Search ..... 373/81.2, 81.3, 80 C, 373/81 D, 194 R, 77 R, 80.1, 186.2, 80 R, 187.5

[56] References Cited

U.S. PATENT DOCUMENTS

| | | | |
|---|---|---|---|
| 1,140,399 | 5/1915 | Righter | 273/81.4 X |
| 1,648,354 | 11/1927 | Lied | 273/81.4 X |
| 2,321,773 | 6/1943 | Ruemelin | 273/81.3 |
| 2,938,728 | 5/1960 | Green | 273/165 |
| 2,962,288 | 11/1960 | Lowden | 273/165 |
| 3,533,630 | 10/1970 | Monaco | 273/165 |
| 3,874,668 | 4/1975 | Flege | 273/81.3 |
| 4,252,317 | 2/1981 | Vezina | 273/81.2 |
| 4,795,153 | 1/1989 | Thomas | 273/81.3 |
| 4,819,944 | 4/1989 | Doane | 273/81 D |
| 5,088,738 | 2/1992 | Mundt et al. | 273/193 |
| 5,125,657 | 6/1992 | Beil | 273/77 R |

*Primary Examiner*—George J. Marlo
*Attorney, Agent, or Firm*—Myron E. Click

[57] ABSTRACT

A golf putter, with an extended length shaft having an upper end adapted to be held against the front of the golfer's body in an anchor position during the putting stroke.

A club head is affixed to the lower end of the shaft, and has a planar ball-striking face formed thereon. A shaft grip is positioned intermediate the upper and lower ends. The shaft grip extends backwardly from the shaft means away from and transverse to the ball-striking face of the club head. The shaft grip is positioned along the length of the shaft to enable gripping thereof by the golfer's other hand. The shaft grip may be one elongated member, or a pair of vertically spaced elongated members. When the spaced elongated members are used, the shaft may be separated at the inner ends of the elongated members while the outer ends are connected together to form a U-shaped shaft grip whereby the shaft grip becomes a part of a continuous shaft having a U-shaped bend intermediate the club head and the upper end of the shaft.

11 Claims, 1 Drawing Sheet

GOLF PUTTER

BACKGROUND OF THE INVENTION

1. Field of the invention

This invention relates to golf putters in general and, in particular, to golf putters which can be used to stroke a putt with a minimum of body movement to improve accuracy.

2. Description of the Prior Art.

A major part of the game of golf is putting, which requires a great deal of precision. There are a wide number of different types of putting strokes, each of which are slightly different from each other. These strokes all have one common ingredient and that is that the stroke is to be precisely repeated each time. Difficulty arises in achieving that precise repetition For example, in the most common putting stroke with available commercial, standard length putters, the golfer addresses the ball in a stance that is parallel to the target line, bends over the target line, and strikes the ball by moving the putter back and forward with his arms. While most think that only the arms are moving, in fact there are minute weight and body balance changes that all take place during the putting stroke. These minute body motion changes affect the wrists, elbows, upper arms, hips, knees and ankles, all at the same time. These minute changes begin the instant we initiate the stroke, creating initial moderate upper body motion and changing the weight and body balance.

Preferably, the conventional putting stroke is one fluid motion. The ankles and feet evert and invert with the back swing and reverse follow on the forward swing, with a right foot plantar flex. The knees flex and the quadriceps and hamstrings contract isometrically as the golfer addresses the ball. The back is straight in the coronal and sagittal planes, but rotates around the vertical axis as the shoulders rotate with respect to the plane of the feet. This truncal rotation occurs because the hips do not rotate as much as the shoulders.

All of the above-noted changes are relatively minute, except for the arm swing. The usual result is a "hip arc" putter path motion as the ball is stroked, causing the putter face to be "open" at the end of the back swing and "closed" at the end of the forward swing. While the "open" and "closed" positions are only slight deviations, they are nonetheless deviations from the required putter face orientation at the point of impact, i.e. perpendicular to the desired path for the ball to travel. So, considering all of the variables noted above, even though each has only a minute impact, it is not hard to understand why it is so difficult to obtain and maintain a correct, repetitive putting stroke—even for professional golfers.

Obviously, since the ability to have a good, repetitive putting stroke is so important, a number of products have been developed to improve putting strokes. U.S. Pat. No. 4,605,228 discloses a putter configuration which is used in a modified croquet style stance using the golfer's arm as a part of a pendulum arm. However, because of the relatively short shaft, constant modification of the golfer's stance is required in order to use the putter for various length putts, causing inconsistent results.

U.S. Pat. No. 3,679,207 also teaches the use of a modified croquet style putting using an extended length or long shaft putter. While the position and stance variation problems are alleviated by this configuration, the golfer's body has a tendency to twist as the putter is swung, introducing the "hip arc" effect described above.

Another interesting development is disclosed in U.S. Pat. No. 3,874,668. While this putter was developed for use by golfers who are handicapped by having only one arm for use during the putting stroke, it does help reduce some unwanted body motion. This putter has an extended length shaft, with the top end of the shaft having affixed thereto a semi-circular C-shaped band which is adapted to support the shaft about and against the upper portion of the golfer's forearm. The shaft is bent intermediate the club head and top end into a generally horizontally disposed V-shape, with the top leg of the V defining a handle or gripping area. However, the C-shaped band engaging the forearm is also moving during the swing, so that there is no fixed reference point.

Therefore, none of the above-noted or other prior art putters meet the goal of reducing or eliminating as many of the physical geometric body control variables as possible.

Accordingly, it is an object of this invention to provide an improved golf putter.

It is a further object of this invention to provide an improved golf putter which eliminates unnecessary body movement and reduces other body control variables during the putting stroke.

Other objects, advantages and features of this invention will become apparent when the following description is take in conjunction with the accompanying drawings.

SUMMARY OF THE INVENTION

An improved, extended length shaft golf putter which includes a putter having a ball-striking face, and a shaft means for moving the putter head. The lower end of the shaft means is affixed to the putter head, and the upper end is adapted to be held in a fulcrum-anchor position against the golfer's chest by one of the golfer's hands.

A shaft grip section means is positioned and joined to the shaft intermediate the ends of the shaft means. The shaft grip means extends backwardly away from and is perpendicular to the ball-striking face of the putter head.

In a first embodiment, the shaft grip means is an elongated member normally disposed in a substantially horizontal position, which may be pivoted to a position adjacent the shaft for storage. A second embodiment has a U-shaped configuration. The shaft has upper and lower portions. An upper leg of the U-shape is joined to the lower end of the upper portion of the shaft. A lower leg of the U-shape is joined to the upper end of the lower portion of the shaft. Other handle configurations are discussed in the description hereinafter.

BRIEF DESCRIPTION OF THE DRAWINGS

In the drawings, where like numerals are employed to designate like parts throughout.

DESCRIPTION OF PREFERRED EMBODIMENTS

Referring now to FIGS. 1 through 5 there is illustrated a first embodiment of a golf putter embodying the teachings of this invention. The putter indicated generally at 10 includes a club head 14 having a ball-striking face 16 formed thereon the face preferably being planar across the entire face surface.

Figure 3:
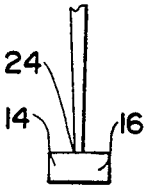
FIG. 3 is a partial front view of a putter of this invention showing a center-mounted putter head.

A shaft means 20 has an upper end 22 and a lower end 24 affixed to the club head 14 by any of the various methods well known to those skilled in the art. In the front view of FIG. 2 it can be seen that the lower end 24 of the shaft 20 is affixed to club head 14 at a point offset from the center of club head 14, as may be preferred by some golfers. The end of the club head 14 which is remote from the shaft 20 may be weighted to reduce or eliminate any torque effect from the ball being struck by face 16 away from the axis of shaft 20. Alternatively, as shown in FIG. 3, the shaft 20 may be affixed to the center of the club head 14, to assist in alignment of a desired ball striking position on the club face 16, and to remove any torque effect with respect to shaft 20.

Figure 1:
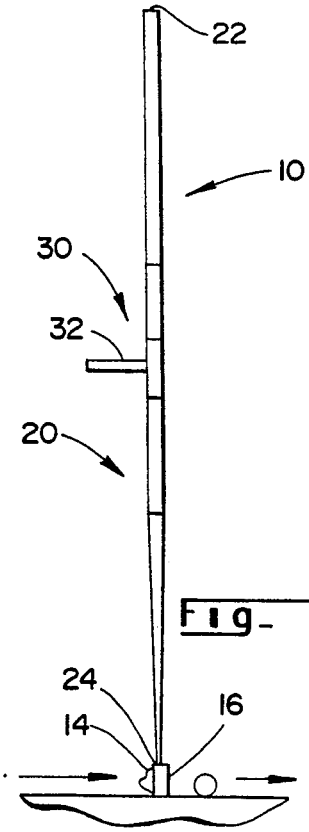
FIG. 1 is a side view of a golf putter embodying the teachings of this invention.
Figure 2:
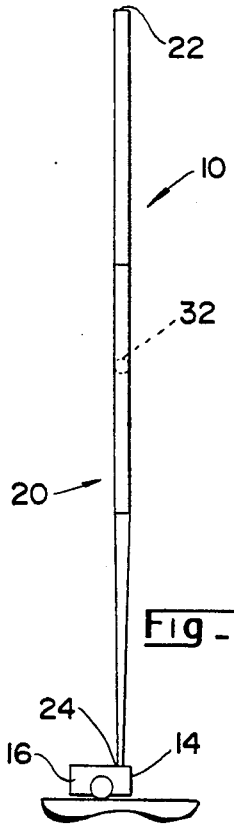
FIG. 2 is a front view of the putter illustrated in FIG. 1.

A shaft grip section means is indicated generally at 30, and in this embodiment is an elongated member 32 joined to shaft 20 intermediate the upper end 22 and lower end 24. The member 32 is in a substantially horizontal position, but may be tilted slightly upwardly or slightly downwardly, depending upon how the golfer grips the handle, e.g. how many fingers are to be wrapped around the handle. In FIG. 1, the elongated member 32 may be joined to shaft 20, by a pin, bolt or other suitable means known to those skilled in the art, in a substantially horizontal position. The member 32 extends backwardly away from shaft 20 and transverse or perpendicular to the plane of the ball striking point on the face 16 of club head 14.

Figure 4:
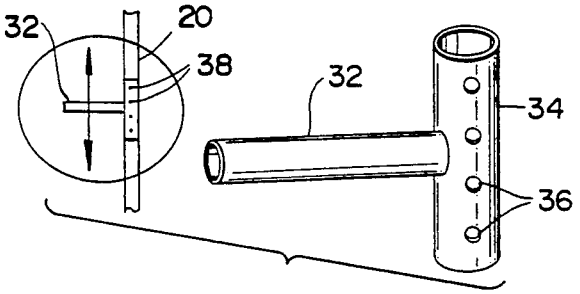
FIG. 4 illustrates structure for selectively positioning a shaft grip section at spaced points on the shaft of a putter as shown in FIG. 1.

Referring now to FIG. 4, there is illustrated a means for selectively joining said elongated member 32 to one of a plurality of vertically spaced positions along shaft 20 to accommodate different body dimensions of different golfers, e.g. different arm lengths, leg lengths, trunk lengths, etc. A sleeve 34 having a plurality of transverse bores 36 formed therein is slidably mounted on shaft 20. A plurality of bores 38 are formed in shaft 20, with spacing therebetween corresponding to the bores 36 formed in sleeve 34. The sleeve 34 can be moved up or down shaft 20 and secured in a selected position by pins, bolts, screws, or the like.

Figure 5:
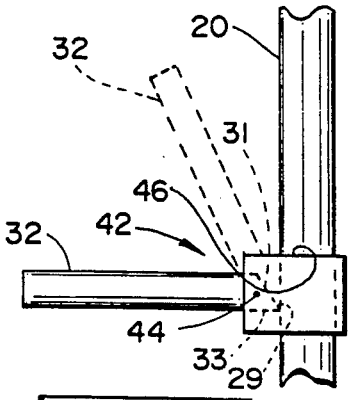
FIG. 5 illustrates structure for pivotably supporting a shaft grip on a shaft.

Referring now to FIG. 5, there is illustrated a shaft grip joining means which includes means 42 for pivotably supporting the elongated handle member 32. A clamp means 46 carries a pivot pin 44 which is threaded through ear extensions of clamp 46. The end 33 of member 32 adjacent the shaft 20 is pivotably mounted on pin 44 between the ear extensions of clamp 46. The member end 33 is chamfered at 31 to enable handle 32 to be pivoted up to and back from a position adjacent the shaft 20, as noted by the handle position shown in phantom lines and the two-headed, arcuate arrow. The end 29 of the chamfer 31 is long enough so that when the member 32 is returned to the substantially horizontal position, the end 29 will jam against shaft 20 to hold the member 32 in that position for putting. The putter may thus be more easily inserted into and removed from a golf bag. Alternate structures are available holding the member 32 in both the vertical and horizontal positions.

Figure 6:
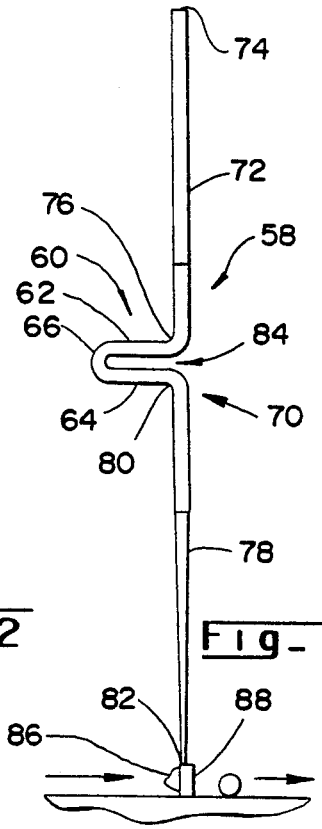
FIG. 6 is a side view of a second embodiment of a golf putter embodying the teachings of this invention.

Referring now to FIG. 6, there is illustrated a second embodiment of the teachings of this invention. The putter indicated generally at 58 includes a club head 86 having a ball-striking face 88 formed thereon, the face preferably being planar across the entire face surface.

A shaft means is indicated generally at 70, and includes an upper portion 72 having an upper end 74 and a lower end 76, and further includes a lower portion 78 having an upper end 80 and lower end 82. The lower end 82 of shaft portion 78 is affixed to the club head 86 by any of various methods known in the art.

A shaft grip section means is indicated generally at 60, and includes vertically spaced elongated members 62, 64. The members 62,64 may be spaced closely enough together so that a golfer's hand may grip the handle means 60 by wrapping the hand around both members 62,64. Alternatively, the members 62, 64 may be spaced far enough apart so that the golfer may grip either one to move the putter to strike the ball. However, some golfers will receive more "feel" or feedback if they grip the lower member 64 and position the back of the gripping hand against the upper member 62. This tactile "feel" that may be obtained by the golfer may be obtained with variations of the structure shown. For example, the lower end 76 of upper portion 72 of shaft means 70 may be connected to the upper end 80 of lower portion 78 of shaft means 70, to form a continuous shaft.

Obviously, if this structural variation is used, the shaft means 70 will be manufactured as a single piece shaft as shown in FIG. 1. Then the elongated members 62, 64 are joined to the shaft 70 in vertically spaced positions, with the spacing depending upon whether the golfer wants to be able to wrap his hand around both members, grip the top member only, or grip the lower member while positioning the back of that hand against the upper member.

The "feel" is obtained from the "tuning fork" effect obtained from the spaced elongated members. In the structure just discussed, the two elongated members act as the tines or prongs of a tuning fork which will try to vibrate at a frequency indicating that the ball has been struck properly. This can be felt by the golfer's gripping hand. In this instance, the flex points of the members 64 is at their connection point with the shaft 70.

In the structural variation shown in FIG. 6, the lower end 76 of upper shaft portion 72 is separated from the upper end 80 of lower shaft portion 78 by a space 84. The inner end of upper elongated member 62 is connected to the lower end 76 of upper shaft portion 72. The inner end of lower elongated member 64 is connected to the upper end 80 of lower shaft portion 78.

As shown in FIG. 6, the outer ends of elongated members 62, 64 are connected by a bight or curved member 66, to form a U-shaped shaft grip section means 60. There are flex points at the inner ends of elongated members 62, 64 at their connection points with the shaft portions 72, 78. There are also flex points at the outer ends of members 62, 64 at their connection points to the bight 66. Thus, there are four flex sections of the putter that can contribute to the "tuning fork" effect and to the "feel" imparted to the golfer. It is therefore believed that this structure provides the most "feel" for the golfer. While both the shaft grip means and the upper end of the shaft may be covered by a grip wrap of leather, rubber, plastic, etc., a golfer may prefer that the handle means is left unwrapped to obtain more "feel", particularly the U-shaped handle. This embodiment should be constructed as a single piece shaft, whereby the shaft grip section means becomes a part of a continuous shaft having a U-shaped bend intermediate the club head and the upper end of the shaft.

The height of the two elongated members 62, 64 can be changed with respect to either the upper end or lower end of the shaft means by providing a telescoping structure in either the upper portion or the lower portion, or both, of the shaft means. Thus, at the time of purchase the putter can be specifically fitted to the individual golfer's body dimensions. After the telescoping portions have been adjusted, they can be fixed at the adjusted position by crimping, adhesive, welding, or the like.

To use either of the two embodiments disclosed herein, the golfer takes his stance at address parallel to the target line desired. The target line referred to is the direction that the golfer desires for the ball to travel initially. If the green is level, this is a straight line from the ball to the hole. If the green has one or more "breaks" between the ball and the hole, the target line is the initial direction that the golfer starts the ball, allowing the breaks to curve the ball back to the hole. The line described by the toes of the golfer's feet is preferably parallel to the target line.

Figure 7:
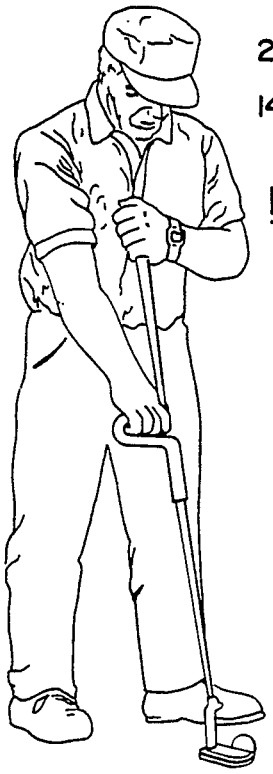
FIGS. 7 and 8 illustrate the use of such golf putters by golfers.
Figure 8:
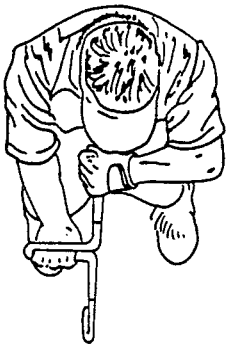

As shown in FIG. 7 and 8, the golfer leans forward until his putting arm and hand hang straight down. The golfer grasps the upper end of the putter with the other hand, obtaining a fulcrum-anchor position for the upper end of the putter by holding his other hand and the upper end of the putter, in position for pivoting the putter shaft, against the front of his body—preferably against the upper chest area. It is preferred that the putter shaft will be vertical and directly above the target line. If the putting arm is also hanging straight down over the target line, both the axes of the putter shaft and the putting arm will define a plane that includes the target line.

The shaft grip section is grasped by the hand of the putting arm. In FIG. 7 the putting hand is gripping the upper elongated member of the U-shaped means. In FIG. 8, the putting hand is gripping the lower elongated handle of the U-shaped means, with the back of that hand touching the upper elongated member to obtain more "feel" during the putting stroke. As noted hereinafter, the two elongated members of the U-shaped means may be placed close enough together so that the putting hand and fingers can wrap around and grasp both members. As also noted hereinbefore, a single elongated member may be used as a shaft grip section means to be gripped by the putting hand.

Whichever shaft grip means is used it should be located along the shaft so that when the golfer assumes his stance and leans over as described above, the putting arm is fully extended downwardly in a straight line, so that the putting arm pivots only at the shoulder. Since the putting arm is being held straight down, it is much more difficult to have any volar and dorsal flexion of the wrist when there is no ulnar deviation in the forearm. The wrist can be virtually locked.

With the axes of the putter handle, putter shaft, and putter arm being in the same plane, and the shaft and arm hanging straight down, a smooth pendulum motion can be obtained along the target line with virtually no motion in any joints other than that shoulder of the putting arm. Since fewer body elements are called into motion, the tendency of other body parts to interreact to maintain body balance is reduced, or eliminated.

In contrast, when a conventional long shaft putter is used with the upper end of the shaft being held against the chest, the putter shaft itself must be gripped by the putting hand along the vertical shaft. This puts the wrist in a position where there can be considerable flexion in the wrist, as well as more ulnar deviation in the forearm, plus movement in other joints as the palm of the putting hand pushes the putter.

While the choice of the specific components, and their arrangement in the preferred embodiments described hereinbefore, provide the best results and advantages over the prior art, the invention is not limited to those specific components and their arrangement. Therefore, the forms of the invention shown and described is to be taken as illustrative only, and changes may be made without departing from the spirit and scope of the invention.

There has thus been disclosed apparatus which differs structurally from, provides functions not performed by, and has clear advantages over the prior art.

We claim:

1. A golf putter, comprising:

(a) a club head having a ball-striking face formed thereon, (b) shaft means for moving said club head to strike a golf ball, said shaft means having a lower end affixed to said club head, said shaft means extending upwardly from said club head and terminating in an upper end which is to be held in a fulcrum-anchor position against the front of a golfer's body by one of the golfer's hands and, (c) shaft grip section means positioned intermediate said upper and lower ends of said shaft means, said shaft grip section means extending backwardly away from and substantially transverse to a plane defined by said ball-striking face of said club head, said shaft grip section means being positioned along the length of said shaft means a predetermined distance from said upper end of said shaft means so that with said upper end of said shaft means held against the upper front portion of a golfer's body with the head of one arm, the golfer's other arm may be fully extended to grip said shaft grip section.

2. A golf putter as defined in claim 1 in which said shaft grip means comprises a single elongated member.

3. A golf putter as defined in claim 1 in which said shaft grip means comprises upper and lower vertically spaced elongated members.

4. A golf putter as defined in claim 3 in which said elongated members are spaced so that both members can be grasped at the same time by the gripping hand of the golfer to obtain a tuning fork feel at impact with the golf ball, said upper and lower members being connected to said shaft means to act as tines of a tuning fork and vibrate at a frequency which will indicate that the ball has been struck properly.

5. A golf putter as defined in claim 3 in which said elongated members are connected to said shaft means and are spaced so that when the lower of said elongated members is gripped by the golfer, the back of the gripping hand may be positioned against the upper of said elongated members to obtain a tuning fork feel at impact with the golf ball when the elongated members act as tines of a tuning fork and try to vibrate at a frequency which will indicate that the ball has been struck properly.

6. A golf putter as defined in claim 3 in which the ends of said elongated members remote from said shaft means are connected.

7. A golf putter as defined in claim 6 in which said shaft means is separated into upper and lower shaft portions at and attached to the respective inner ends of said elongated members; whereby said shaft grip means becomes a part of a continuous shaft means having a substantially U-shaped bend intermediate said club head and said upper end of shaft means.

8. A golf putter as defined in claim 1 in which said shaft grip means includes an elongated member, and which further includes means for pivotably supporting said elongated member adjacent to said shaft means and means for joining said pivotably supporting means to said shaft means, whereby said elongated member can be pivoted between a substantially horizontal position for use during a putting stroke and a substantially vertical storage position adjacent said shaft means.

9. A golf putter as defined in claim 1 in which said shaft grip means includes an elongated member, and which further includes means for selectively joining said elongated member to one of a plurality of vertically spaced positions along said shaft means to accommodate different body dimensions of different golfers.

10. A golf putter as defined in claim 1 in which said lower end of said shaft means is affixed to the center of said club head to assist in alignment of a desired ball striking point on said club head face, and to remove any torque effects when said club head strikes a golf ball.

11. A golf putter as defined in claim 1 wherein said upper front portion of the golfer's body is the chest.

* * * * *